US009637295B1

(12) United States Patent
Chang

(10) Patent No.: US 9,637,295 B1
(45) Date of Patent: May 2, 2017

(54) PACKAGING STRUCTURE

(71) Applicant: LI TAI GREEN PACKAGING CO., LTD., New Taipei (TW)

(72) Inventor: Kun-Hsiang Chang, New Taipei (TW)

(73) Assignee: Li Tai Green Packaging Co., Ltd., New Taipei (TW)

( * ) Notice: Subject to any disclaimer, the term of this patent is extended or adjusted under 35 U.S.C. 154(b) by 0 days.

(21) Appl. No.: 14/955,596

(22) Filed: Dec. 1, 2015

(51) Int. Cl.

| | |
|---|---|
| ***B65D 5/02*** | (2006.01) |
| ***B65D 5/44*** | (2006.01) |
| ***B65D 81/02*** | (2006.01) |
| ***B65D 5/42*** | (2006.01) |

(52) U.S. Cl.
CPC ..... *B65D 81/02* (2013.01); *B65D 5/0254* (2013.01); *B65D 5/0281* (2013.01); *B65D 5/4266* (2013.01); *B65D 5/443* (2013.01)

(58) Field of Classification Search
CPC .... B65D 81/02; B65D 5/0281; B65D 5/0254; B65D 5/443; B65D 5/4266
USPC ..... 229/183, 185.1, 195, 198.2, 931
See application file for complete search history.

(56) References Cited

U.S. PATENT DOCUMENTS 1,960,925 A * 5/1934 Senat ..... B65D 5/14 229/109
2,723,074 A * 11/1955 Wagner, Jr. ..... B65D 5/3621 229/117
2,764,337 A * 9/1956 Bolding ..... B65D 5/5016 206/418
2,808,977 A * 10/1957 McCormick ..... B65D 5/0281 206/521
2,985,075 A * 5/1961 Knutsson-Hall ..... B31B 3/00 229/931
3,027,060 A * 3/1962 Beder ..... B65D 5/0227 229/116.3
3,189,249 A * 6/1965 Fallert ..... B65D 5/0281 229/183
3,286,900 A * 11/1966 Keith ..... B65D 5/001 229/138
4,022,372 A * 5/1977 Graser ..... B65D 5/48036 206/155
4,087,041 A * 5/1978 Centanni ..... B65D 5/566 229/122.32

(Continued)

FOREIGN PATENT DOCUMENTS

TW I271363 1/2007

*Primary Examiner* — Gary Elkins
(74) *Attorney, Agent, or Firm* — Muncy, Geissler, Olds & Lowe, P.C.

(57) ABSTRACT

A packaging structure is an integral formed from a plate material. The plate material includes a main bending line, a first side plate and a second side plate. The first side plate includes a plurality of auxiliary bending lines and a plurality of first connecting sections. The second side plate includes a plurality of cut lines and a plurality of second connecting sections. The plate material is bent along the main bending line, and the first auxiliary bending lines of the first side plate and the cut lines of the second side plate are bent to allow the first side plate and the second side plate to surround and form a geometric accommodated space for placing an object. Further, an impact of an external force upon the object is reduced through the dual layer structure formed by the first connecting sections and the second connecting sections.

2 Claims, 9 Drawing Sheets

(56) References Cited

U.S. PATENT DOCUMENTS

| | | | | | |
|---|---|---|---|---|---|
| 4,182,477 | A * | 1/1980 | Paige | B65D 5/0281 | 229/101 |
| 4,244,510 | A * | 1/1981 | Snyder | B65D 5/0281 | 229/109 |
| 6,189,776 | B1 * | 2/2001 | Smith | B65D 5/0281 | 206/425 |
| 7,597,194 | B2 * | 10/2009 | Oberliesen | B65D 5/26 | 206/386 |

* cited by examiner

PACKAGING STRUCTURE

FIELD OF THE INVENTION

The present invention relates to a packaging structure, and particularly to a packaging structure that enhances a protection effect and assembly strength by a dual layered structure.

BACKGROUND OF THE INVENTION

As modern merchandize transactions are extremely frequent, to prevent the merchandize from receiving external forces and becoming damaged, corrugated paper boxes and cushioning materials are extensively applied in product transportation. A corrugated paper box not only is light and rigid, but also internally includes a wavy sandwich core sheet that is flexible and shock absorbent. Thus, an object in the corrugated paper box can be better protected, and damages caused by external vibrations upon the object can also be reduced. For example, the Taiwan Patent 1271363 discloses an improved cardboard box structure. The improved cardboard box structure includes a surrounding side plate, and a plurality of covering wing plates disposed at two sides of the surrounding side plate. At least one of the covering wing plates includes a positioning lug. During an application process of the improved cardboard box, the surrounding side plate is surrounded to form an accommodating space, the covering wing plates are bent to cover two opposite sides of the accommodating space, and the positioning lug is bent and connected at the surrounding side plate, thereby forming a packaging structure for an object to be placed therein.

However, as the surrounding side plate and the covering wing plates are single layer structures, the improved cardboard box structure is liable to be dented caused by impacts during the application process. Further, the improved cardboard box structure, after forming a box through bending, is only secured by connecting the positioning lug at the surrounding side plate. As a result, during the application process of the improved cardboard box structure, disengagement or separation due to a small connecting area of the positioning lug is easily incurred, such that the improved cardboard box structure becomes incapable of maintaining the box structure for accommodating the object.

SUMMARY OF THE INVENTION

The primary object of the present invention is to solve the issues of an unsatisfactory cushioning effect and inadequate assembly strength of a cardboard box of the prior art.

To achieve the above object, the present invention provides a packaging structure as an integral formed from a plate material. The plate material includes a main bending line that penetrates through two opposite sides of the plate material, and is defined into a first side plate and a second side plate by the main bending line. The first side plate includes a plurality of auxiliary bending lines arranged at an interval, and a plurality of first connecting sections defined by the auxiliary bending lines. The second side plate includes a plurality of cut lines disposed respectively correspondingly to the auxiliary bending lines, and a plurality of second connecting sections defined by the cut lines and respectively corresponding to the first connecting sections. The main bending line is a semi-cut line, the cut lines are in a semi-detached form, and each auxiliary cut line is an indentation. The second connecting section at one end of the second side plate includes a first fastening plate in a protruding manner, and the second connecting section at the other end of the second side plate includes a first fastening groove. The plate material has a flatly spread state, and an application state. In the application state, the first side plate and the second side plate are overlapped along the main bending line, the auxiliary bending lines at an inner side of the first side plate are bent, and the cut lines at an outer side of the second side plate are bent. As such, the first fastening plate at the second side plate is assembled with the first fastening groove to cause the first side plate and the second side plate to surround and form a geometric accommodated space.

In one embodiment, the length of the second connecting section provided with the first fastening plate is longer than the length of the corresponding first connecting section.

In one embodiment, the plate material includes a covering plate formed at one side of the second connecting section opposite the first connecting section. The covering plate has a shape that conforms to the geometric accommodated space. Further, the plate material includes a second fastening plate formed at any side of the covering plate that is not connected to the second connecting section, and a second groove disposed at the other second connecting section and for assembling and securing the second fastening plate.

Through the above implementation, the present invention provides following features compared to the prior art.

In the present invention, the plate material is provided with the main bending line, and is defined into the first side plate and the second side plate at two sides of the main bending line. When the first side plate and the second side plate are overlapped, the first connecting sections and the second connecting sections form the geometric accommodated space for placing an object through bending the auxiliary bending lines and the cut lines. Further, with the dual layer structure formed by the first connecting lines and the second connecting lines, the impact of external forces upon the object can be reduced. Further, in the present invention, by assembling the first fastening plate at the first fastening groove, the assembly strength of the plate material is reinforced, thereby solving the issue of disengagement or separation easily occurred in a cardboard box of the prior art.

DETAILED DESCRIPTION OF THE PREFERRED EMBODIMENTS

Figure 1:
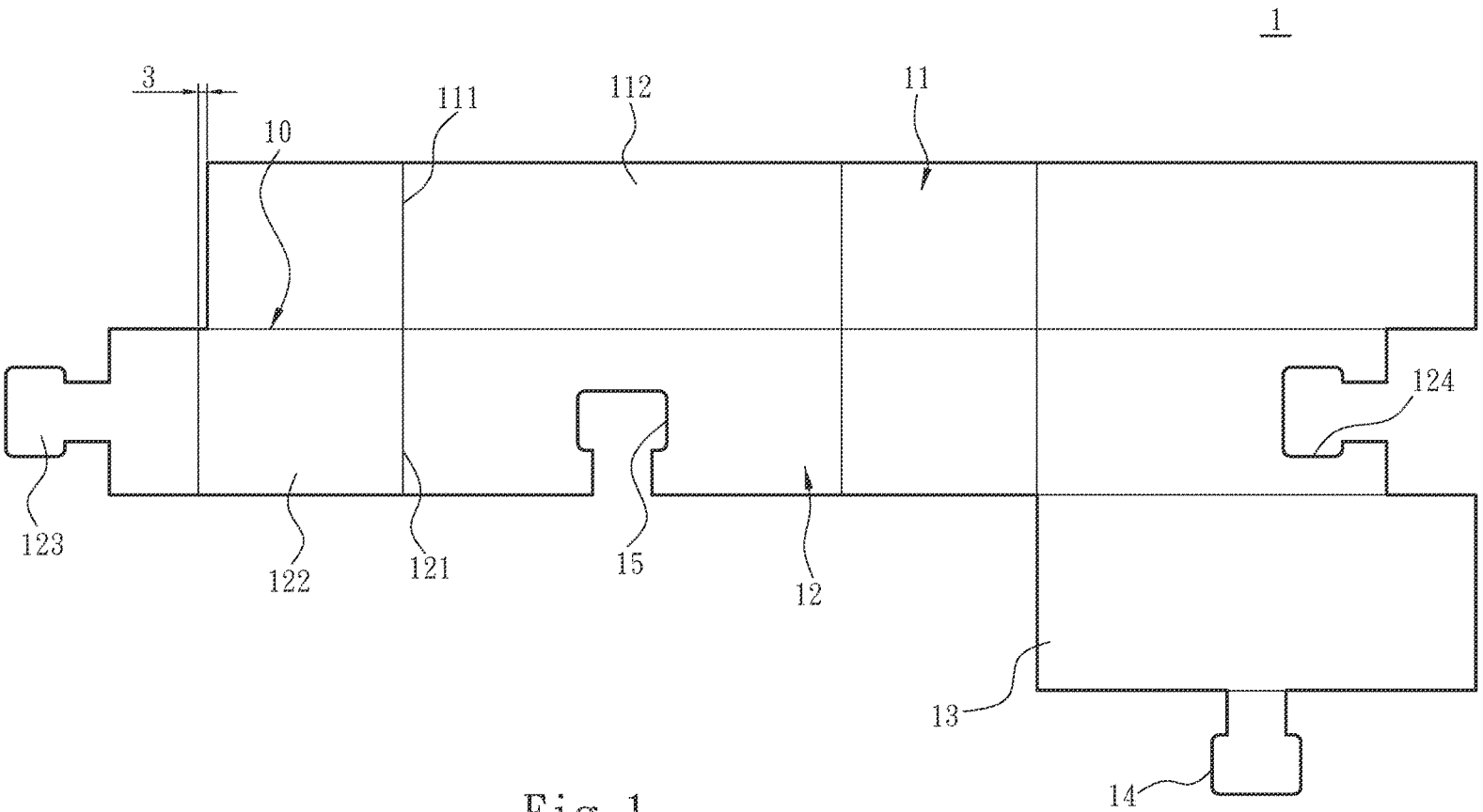
FIG. 1 is a top view of the present invention in a flatly spread state.

Referring to FIG. 1, the present invention provides a packaging structure as an integral formed from a plate material 1. Before a bending means is performed, the plate material 1 is in a flatly spread state. When a bending means is performed, the plate material 1 enters an application state to further allow any desired object (not shown) such as a smart phone to be placed therein, so as to protect the object placed therein from damages caused by external factors.

More specifically, the plate material 1 includes a main bending line 10 that penetrates through two opposite sides of the plate material 1, and is defined into a first side plate 11 at one side of the main bending line 10, and a second side plate 12 at the other side of the main bending line 10 and opposite the first side plate 11. The shape of the first side plate 11 corresponds to the shape of the second side plate 12. The first side plate 11 includes a plurality of auxiliary bending lines 111 arranged at an interval, and is defined and forms a plurality of first connecting sections 112 by the auxiliary bending lines 111. On the other hand, the second side plate 12 includes a plurality of cut lines 121 arranged at an interval and appearing as a semi-detach form, and is defined and forms a plurality of second connecting sections 122 by the cut lines 121. It should be noted that, the auxiliary bending lines 111 respectively correspond to the cut lines 121, and the first connecting sections 112 respectively correspond to the second connecting sections 122. The second side plate 12 further includes a first fastening plate 123 disposed in a protruding manner at the second connecting section 122 at one end, and a first fastening groove 124 disposed at the second connecting section 122 at the other end. The shape of the first fastening plate 123 corresponds to the shape of the first fastening groove 124, such that the first fastening plate 123 may be assembled in the first fastening groove 124.

Figure 2:
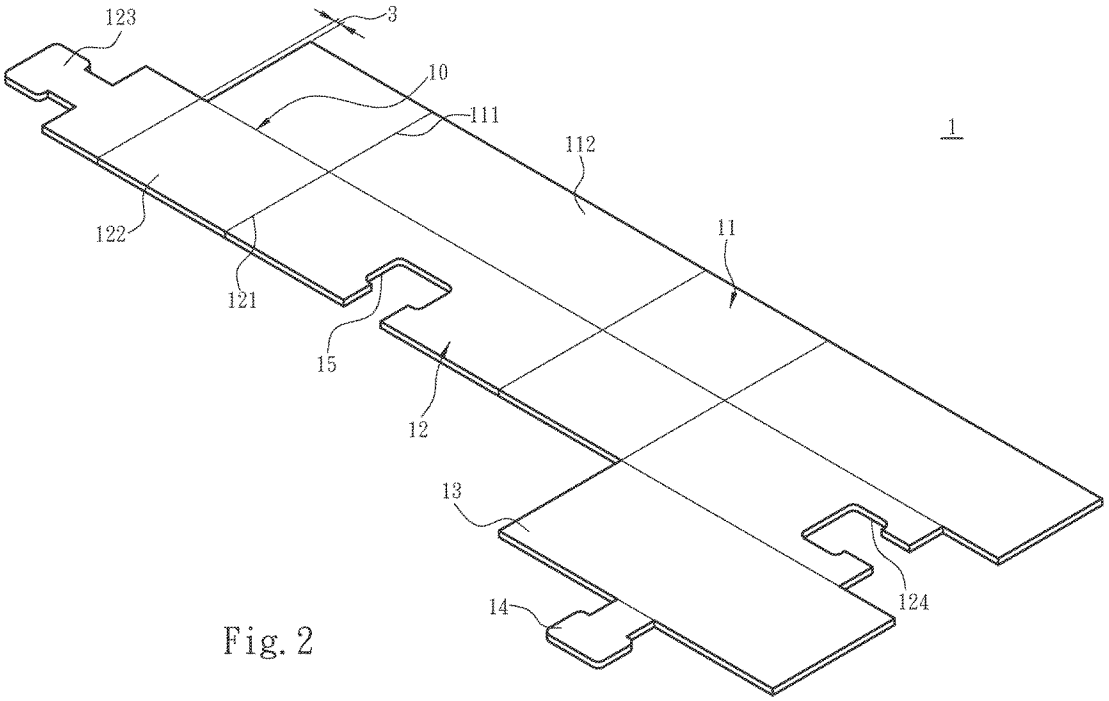
FIG. 2 is a first schematic diagram of performing a bending means of the present invention.
Figure 3:
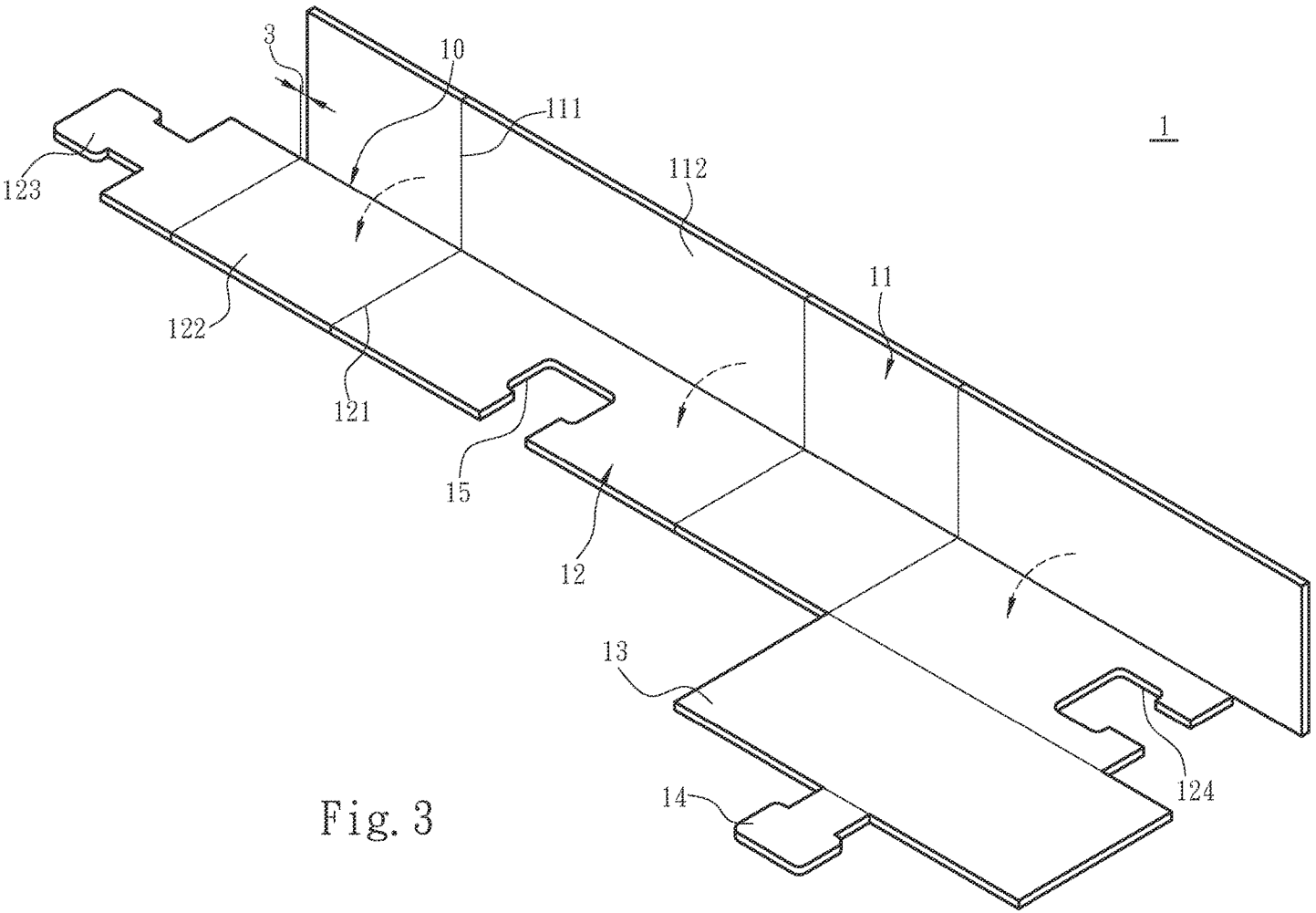
FIG. 3 is a second schematic diagram of performing a bending means of the present invention.
Figure 4:
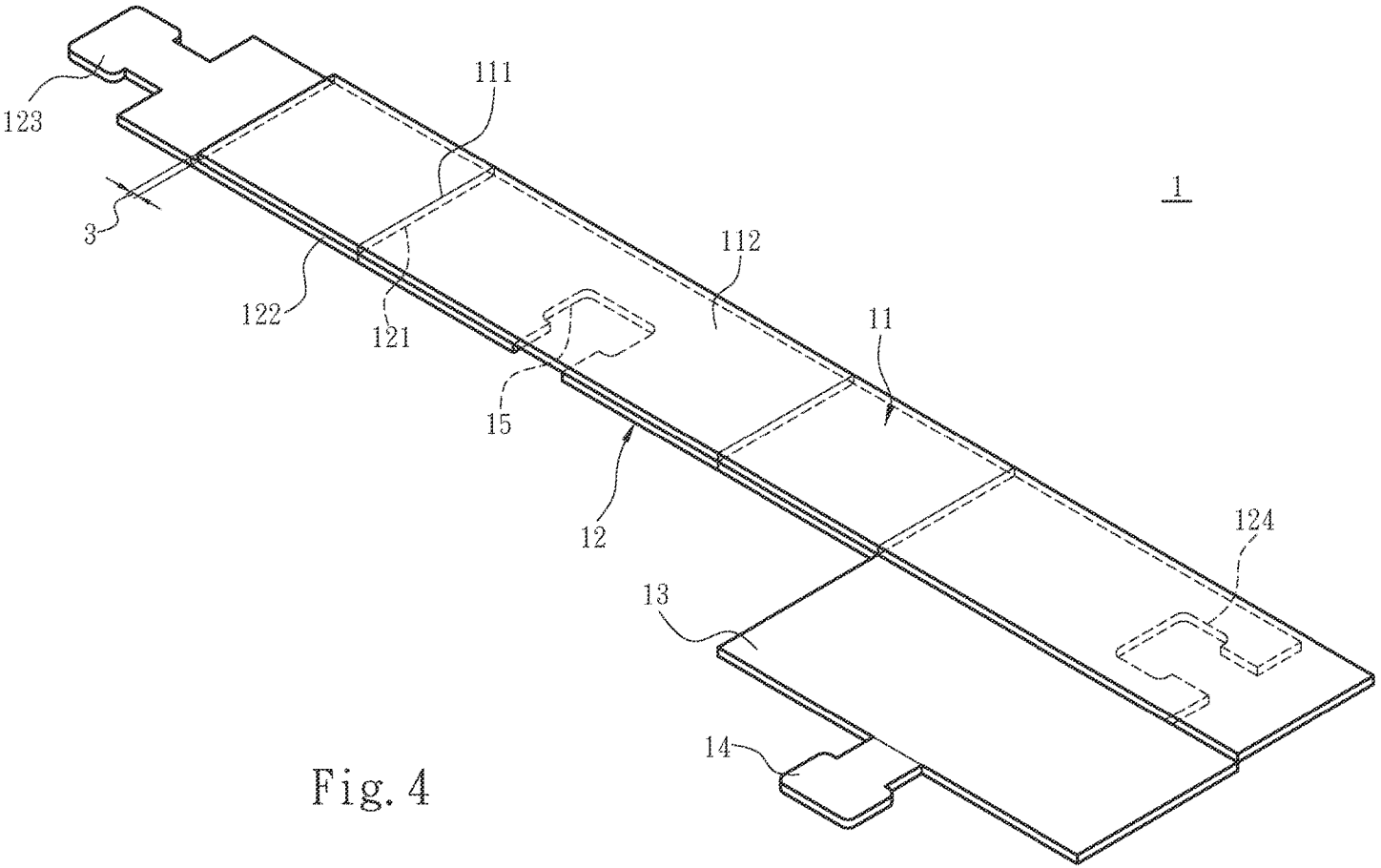
FIG. 4 is a third schematic diagram of performing a bending means of the present invention.
Figure 5:
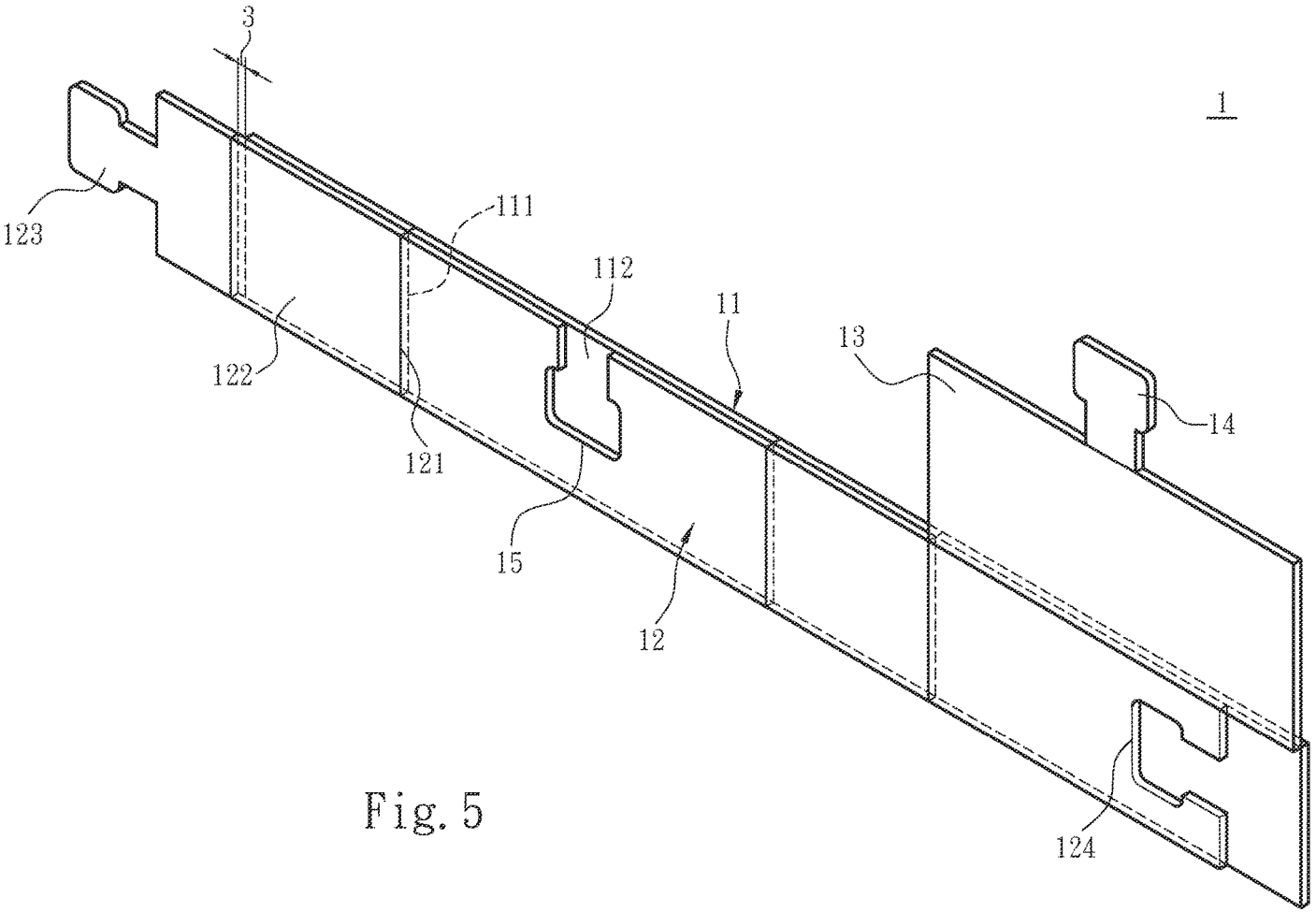
FIG. 5 is a fourth schematic diagram of performing a bending means of the present invention.
Figure 6:
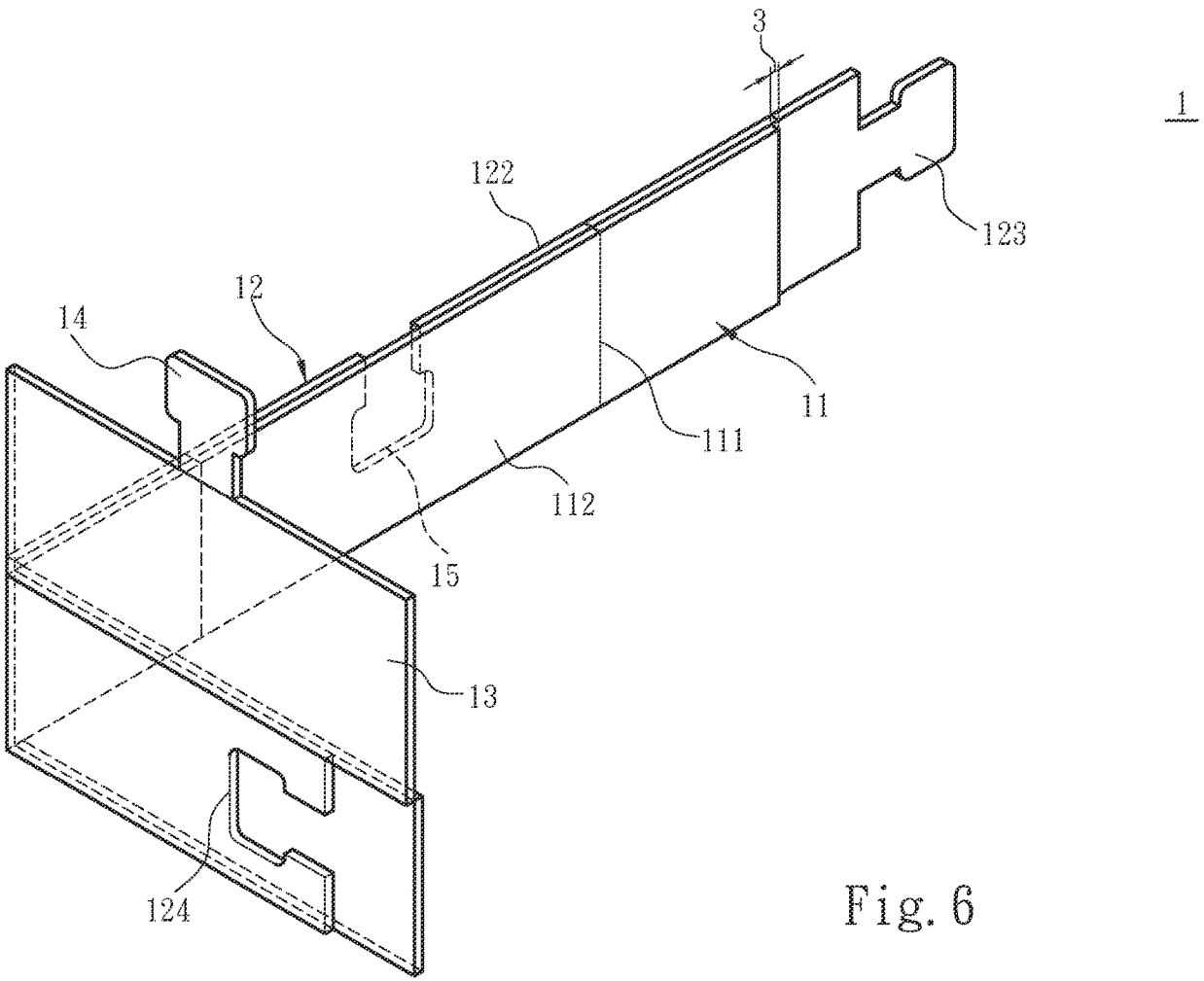
FIG. 6 is a fifth schematic diagram of performing a bending means of the present invention.
Figure 7:
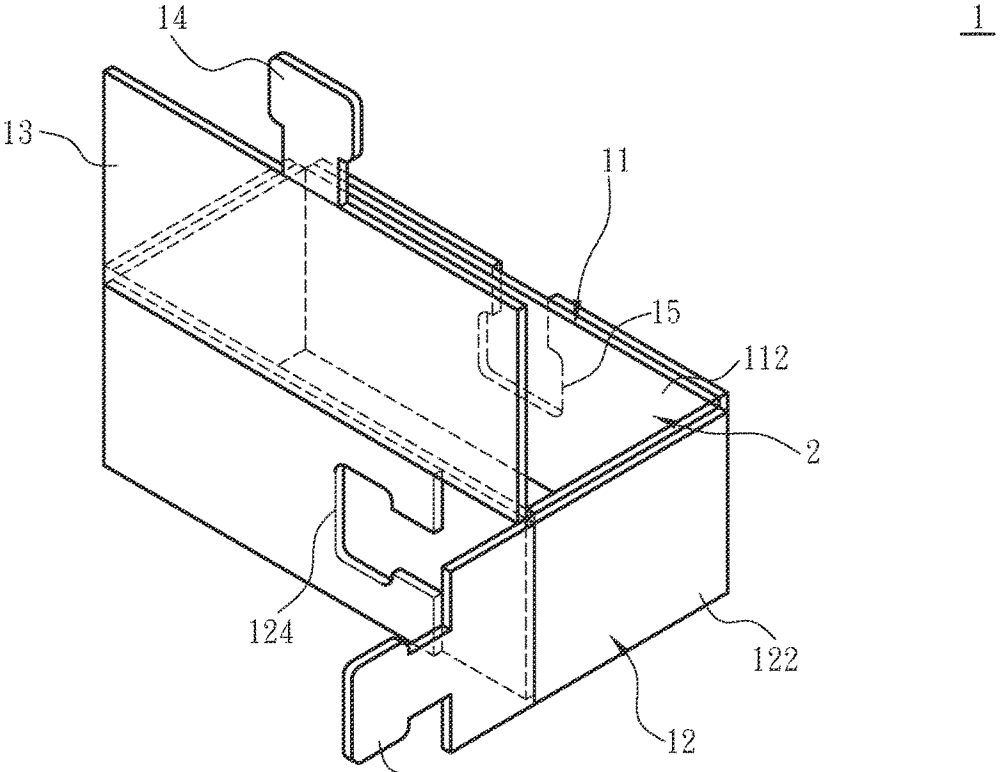
FIG. 7 is a sixth schematic diagram of performing a bending means of the present invention.
Figure 8:
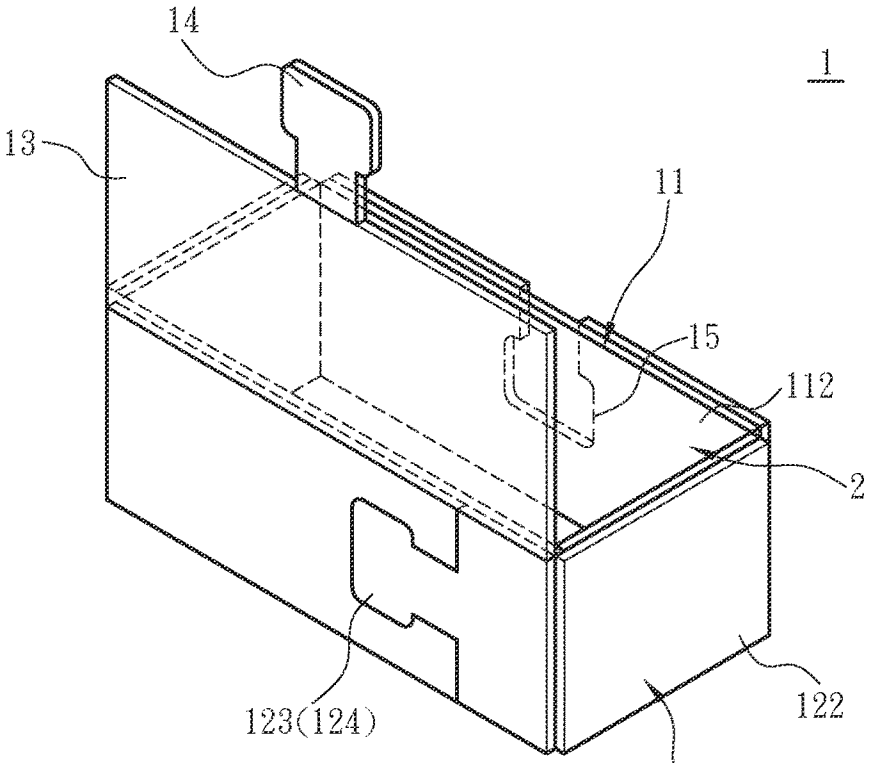
FIG. 8 is a first schematic diagram of an application state of the present invention.
Figure 9:
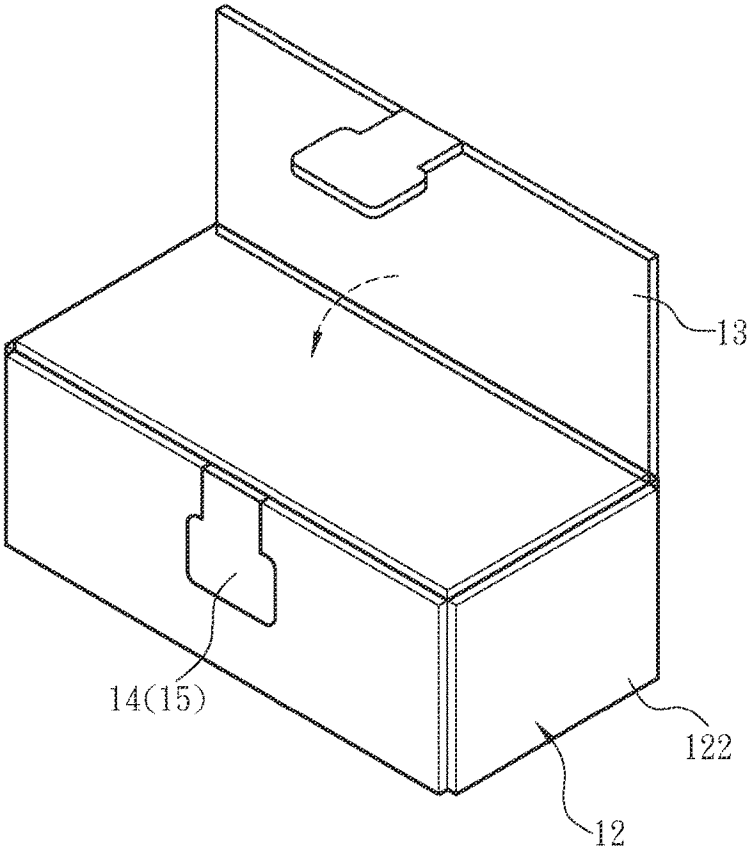
FIG. 9 is a second schematic diagram of an application state of the present invention.

Referring to FIG. 2 to FIG. 8, the plate material 1 enters the application state through following steps of the bending means. As shown in FIG. 2 to FIG. 4, the plate material 1 is first bent along the main bending line 10 to cause the first side plate 11 to overlap the second side plate 12. More specifically, the auxiliary bending lines 111 are symmetrical to the cut lines 121, such that the first connecting sections 112 respectively overlap the second connecting sections 122 when the first side plate 11 overlaps the second side plate 12. As shown in FIG. 6 and FIG. 7, the first side plate 11 is bent along the auxiliary bending lines 111, and the second side plate 12 is bent along the cut lines 121. Thus, the second connecting sections 122 surround at an outer side of the first connecting sections 112, and the first side plate 11 and the second side plate 12 surround and form a geometric accommodated space 2. As shown in FIG. 8, the first fastening plate 123 is assembled in the first fastening groove 124. Thus, the object can be placed in the geometric accommodated space 2, and an impact caused by external forces upon the object can be reduced by the dual layer structure formed by the first connecting sections 112 and the second connecting sections 122. Further, by assembling the first fastening plate 123 at the first fastening groove 124, the assembly strength of the plate material 1 is reinforced, thereby solving the issue of disengagement or separation easily occurred in a cardboard box of the prior art.

More specifically, the main bending line 10 and the cut lines 121 are semi-cut lines. For example, the plate material 1 may be any plate material 1 (e.g., corrugated paper or plastic foam plates). When the plate material 1 is cut by a cutting blade to produce a cut opening, the main bending line 10 is formed at the position of the plate material 1 corresponding to the cut opening. It is thus known that, the main bending line 10 and the cut lines 121 are formed by parts of the plate material 1 that are not fully cut. As such, the plate material 1 is allowed to bend along the main bending line 10 towards only one single direction, and the first side plate 11 is allowed to bend along the auxiliary bending lines 111 towards only one single direction.

As the main bending line 10 is a semi-cut line, the first side plate 11 is allowed to overlap the second side plate 12. Further, as the cut lines 121 are also semi-cut lines, the second side plate 12 is allowed to bend along the cut lines 121 towards one single direction, such that the second connecting sections 122 are all located at the outer side of the first connecting sections 112 when the bending means is performed on the plate material 1. It should be noted that, each of the auxiliary bending lines 111 is an indentation. When the first side plate 11 is bent along the auxiliary bending lines 111, the structure of the first side plate 11 located at positions of the auxiliary bending lines 111 is extruded and becomes deformed.

Referring to FIG. 1, FIG. 2, FIG. 5 and FIG. 7, it is seen clearly from the diagrams that, in one embodiment, the plate material 1 is a rectangular body after it enters the application state. More specifically, in one embodiment, a 90-degree included angle is present between these auxiliary bending lines 111 and the cut lines 121, and the auxiliary bending lines 111 and one of the cut lines 121 are located on the same straight line. Further, the length of the second connecting section 122 provided with the first fastening plate 123 is longer than the length of the corresponding first connecting section 112, as indicated by a distance difference 3 in FIG. 1. Thus, during the process of bending and assembling the first fastening plate 123 in the first fastening groove 124, between the first connecting section 112 closest to the first fastening plate 123 and the bent first fastening plate 123 is a gap. The first connecting section 112 away from the first fastening plate 123 may be placed into the gap, so that the plate material 1 may form the rectangular body after having entered the application state. Further, the rectangular body formed by performing the bending means on the plate material 1 is an example in an embodiment of the present invention. In an application process of another embodiment of the present invention, the numbers of the auxiliary bending lines 111 and the cut lines 121 may be modified to cause the geometric accommodated space 2 to be a triangle, a quadrilateral, a pentagon, or any desired polygons after the bending means is performed on the plate material 1. Further, the distance between the auxiliary bending lines 111 and the distance between the cut lines 121 may also be modified to cause the geometric accommodated space 2 with symmetry or asymmetry.

Referring to FIG. 1, FIG. 2, FIG. 8 and FIG. 9, in one embodiment, the plate material 1 includes a covering plate 13, which is formed at one side of the second connecting section 122 opposite the first connecting section 112. The shape of the covering plate 13 conforms to the shape of the geometric accommodated space 2. Thus, after the plate material 1 enters the application state, the covering plate 13 may cover the geometric accommodated space 2 to provide a more thorough protection effect. Further, the plate material 1 includes a second fastening plate 14 formed at any side of the covering plate 13 that is not connected to the second connecting section 122, and a second fastening groove 15 disposed at another second connecting section 122 and for assembling and securing the second fastening plate 14.

What is claimed is:

1. A packaging structure, being an integral formed from a plate material, being characterized that:

the plate material is provided with a main bending line that penetrates through two opposite sides of the plate material, and is defined into a first side plate and a second side plate by the main bending line; the first side plate comprises a plurality of auxiliary bending lines respectively arranged at an interval, and a plurality of first connecting sections defined by the auxiliary bending lines; the second side plate comprises a plurality of cut lines respectively corresponding to the auxiliary bending lines, and a plurality of second connecting sections defined by the cut lines and respectively connected to the first connecting sections; the main bending line is a semi-cut line, the cut lines are in a semi-detached form, and the auxiliary bending lines are indentations; the second connecting section at one end of the second side plate is provided with a first fastening plate disposed in a protruding manner, and the second connecting section at one other end is provided with a first fastening groove; the plate material has a flatly spread state, and an application state; in the application state, the first side plate overlaps the second side plate along the main bending line, the auxiliary bending lines at an inner side of the first side plate are bent, and the cut lines at an outer side of the second side plate are bent, such that the first side plate and the second side plate surround and form a geometric accommodated space;

wherein the plate material comprises a covering plate which has a shape conforming to the geometric accommodated space and is formed at one other side of the second connecting section opposite the first connecting section, a second fastening plate formed at any side of the second connecting section not connected to the covering plate, and a second fastening groove disposed at another second connecting section and for assembling and securing the second fastening plate.

2. The packaging structure of claim 1, wherein the length of the second connecting section provided with the first fastening plate is longer than the length of the corresponding first connecting section.

* * * * *